United States Patent [19]

Pozniak et al.

[11] Patent Number: 4,502,847

[45] Date of Patent: Mar. 5, 1985

[54] EXHAUST GAS OPERATED VACUUM PUMP ASSEMBLY

[75] Inventors: Donald J. Pozniak, Utica; Gerald F. Robertson, Mt. Clemens, both of Mich.; Michael J. McClain, Dayton, Ohio

[73] Assignee: General Motors Corporation, Detroit, Mich.

[21] Appl. No.: 427,651

[22] Filed: Sep. 29, 1982

[51] Int. Cl.[3] ..... F04B 35/00; F04B 39/00

[52] U.S. Cl. ..... 417/380; 92/130 R; 92/130 B; 92/143; 417/399; 417/401

[58] Field of Search ..... 417/401, 380, 399; 92/130 R, 130 B, 143; 267/166, 167, 174, 180

[56] References Cited

U.S. PATENT DOCUMENTS

| | | | |
|---|---|---|---|
| 474,248 | 5/1892 | Henderson | 417/401 |
| 2,142,329 | 1/1939 | Nika, Jr. et al. | 417/401 X |
| 3,106,821 | 10/1963 | Ridgway | 60/30 |
| 3,238,886 | 3/1966 | Johnson | 103/150 |
| 3,244,357 | 4/1966 | Bunker | 230/52 |
| 3,250,224 | 5/1966 | Phillips et al. | 103/150 |
| 3,339,830 | 9/1967 | Graham | 230/52 |
| 4,156,416 | 5/1979 | Weisgerber | 123/196 R |

OTHER PUBLICATIONS

Carlson, H., Spring Designer's Handbook, N.Y., Dekker, Inc., 1978, p. 185.

*Primary Examiner*—Irwin C. Cohen

*Attorney, Agent, or Firm*—William A. Schuetz

[57] ABSTRACT

A vacuum pump assembly which is driven by pulsating exhaust gases emanating from an internal combustion engine is disclosed. The pump assembly includes a staged pump means for pumping air from a vacuum source and having a reciprocable pumping member, an actuating means including a reciprocable actuating member drivingly connected to the pumping member and which is driven through first and second strokes to move the pumping member through first and second strokes, respectively, one side of the actuating member being in communication with the exhaust gases and with the actuating and pumping members being movable through their first strokes during the pressure increasing phase of each pressure pulsation and being moved through their second strokes by a nonlinear variable rate spring means during each pressure decreasing phase of each pressure pulsation whereby the pump assembly is operable to pump air from the vacuum source throughout a wide range of engine speeds and loads including high speeds and loads.

6 Claims, 9 Drawing Figures

EXHAUST GAS OPERATED VACUUM PUMP ASSEMBLY

The subject matter of the present application is related to that of three co-pending applications filed concurrently herewith in the names of Michael McClain, Donald Pozniak and Gerald Robertson; Gerald Robertson and Donald Pozniak; and Michael McClain, and assigned to the same assignee as the present application and identified by Ser. No. 427,650, now U.S. Pat. No. 4,479,765, Ser. No. 427,652, and Ser. No. 427,666, now U.S. Pat. No. 4,459,088.

The present invention relates to a pump assembly and more particularly to a vacuum pump assembly which is actuated by exhaust gas pressure pulsations emanating from an internal combustion engine.

Current production automotive vehicles contain many pneumatically operated controls and devices, such as power-assist brakes, cruise controls, controls for air conditioning and heating and EGR valves. Proper operation of these controls or devices requires a source of vacuum, which historically has been taken from the intake manifold of an internal combustion engine used to power the vehicle. The pneumatically operated controls or devices have proved to be relatively inexpensive and reliable when there is sufficient intake manifold vacuum. However, with the introduction of the smaller, fuel efficient automobiles having smaller engines, the level of vacuum in the intake manifold has decreased to the point where it no longer can be relied upon to operate reliably all of the pneumatically operated controls or devices, especially the power-assist brakes, throughout the entire range of speeds and loads of the engine. Consequently, if inexpensive pneumatically operated controls or devices are to be retained in smaller vehicles, it is imperative that a source of vacuum other than the intake manifold be used.

Currently, the assignee the present invention produces vacuum pump assemblies for providing such a reliable source of vacuum. One such pump assembly has a reciprocable pumping member which is actuated through one stroke via an eccentric cam driven from the crankshaft of the engine and moved through its other or return stroke via a spring means. This pump assembly is substantially like that shown in U.S. Pat. No. 4,156,416, issued May 29, 1979, and assigned to the same assignee of the present invention. Another such pump assembly is similar to that of the above-mentioned U.S. patent, but is driven by an electric motor through an eccentric drive rather than by the engine crankshaft. While both of these pump assemblies have been highly satisfactory in operation, they have the drawback that they must be driven either by the engine of the vehicle or by a separate electric motor.

To overcome the use of vacuum pump assemblies which are either driven from the engine or driven by a separate electric motor, the present invention contemplates using the exhaust gases emanating from the internal combustion engine for operating or actuating a vacuum pump assembly. The advantage of using the exhaust gases as the motive force to operate the vacuum pump assembly is that it provides a "free" or nonparasitic energy source which does not in any way affect or detract from the operation of the internal combustion engine or does not require a further drain on the electrical system of the automotive vehicle.

At this point, it should be noted that diaphragm operated fuel pumps have heretofore been provided which are actuated by pressure pulsations taken from either the intake manifold or the crankcase of an engine. Examples of such pumps are shown in U.S. Pat. Nos. 3,238,886 and 3,250,224. It is also known to provide reciprocating pumps for pumping a fluid which are reciprocated by a separate actuating means drivingly connected thereto, the actuating means including a reciprocable diaphragm whose opposite sides are alternately exposed to vacuum from the intake manifold of an engine. Examples of such pump assemblies are illustrated in U.S. Pat. Nos. 3,244,357 and 3,339,830. It is also known to use the pressure pulsations in the exhaust gases emanating from an internal combustion engine to deflect a diaphragm to cause air to be pumped or drawn into the exhaust gases prior to entering an afterburner, as shown in FIG. 1 of U.S. Pat. No. 3,106,821. While FIG. 1 of the latter patent shows a diaphragm operated air pump actuated by the pressure pulsations in the exhaust gases from an internal combustion engine, it has been found that the pump thereshown would not be operable over the full range of engine speeds and loads, especially at high speeds and/or during wide open throttle conditions.

Studies of the pressure profiles of exhaust gases generated by a multi-cylinder internal combustion engine show that the exhaust gases emanate as pressure pulsations whose pressure, frequency and amplitude, when approximated to a cyclic sine wave, vary greatly in accordance with engine speed and operating conditions. The frequency of the cyclic operation is typically on the order of 30 Hertz to 150 Hertz. The amplitude of the pressure pulsations is great enough so that subatmospheric pressures usually exist in each cyclic exhaust gas pulsation for a short period of each cycle even though the average pressure of the cycle is substantially above atmospheric pressure. In typical internal combustion engine exhaust systems, these subatmospheric pressure periods occur to varying degrees during most engine speeds, but disappear at high engine speeds where the pressure pulsations during their entire cycle are above atmospheric pressure.

Accordingly, it is an object of the present invention to provide a new and improved pump assembly, preferably a vacuum pump assembly, for pumping a fluid and which is actuated by pressure pulsations in the exhaust gases from an internal combustion engine and operable to pump the fluid over a wide range of engine speeds and loads including high speed wide open throttle operation.

Another object of the present invention is to provide a new and improved pump assembly, preferably a vacuum pump assembly, for pumping a fluid which is adapted to be actuated by pressure pulsations from the exhaust gases of an internal combustion engine and in which the pump assembly is operative to pump fluid during engine speeds and loads when a portion or period of the pressure pulsations is below atmospheric pressure and during engine speeds and loads when the pressure pulsation cycles are wholly above atmospheric pressure.

Yet another object of the present invention is to provide a new and improved pump assembly, preferably a vacuum pump assembly, which includes a pump means for pumping a fluid and having a reciprocable pumping member movable through first and second strokes, an actuating means including a reciprocable actuating member drivingly connected to the pumping member and which is adapted to be driven through first and second strokes to move the pumping member through its first and second strokes, respectively, one side of the actuating member adapted to be in communication with the exhaust gases of an internal combustion engine whereby pressure pulsations in the exhaust gases during the increasing pressure phase of each pulsation causing the actuating member and pumping member to be moved through their first stroke and allowing the actuating member and pumping member to be moved through their second stroke during the pressure decreasing phase of each pressure pulsation, and a variable rate spring means engageable with one of the actuating or pumping members and which is operable to move the actuating and pumping members through their second strokes during the decreasing pressure phase of each pressure pulsation and whose spring rate increases in a non-linear fashion when compressed by the pressure of the exhaust gas pulsations that increase at increasing engine speeds or loads whereby said pump assembly is operable to pump fluid throughout a wide range of engine speeds and loads including high speeds and wide open throttle conditions.

A further object is to provide a new and improved pump assembly, preferably a vacuum pump assembly, as defined in the next preceding object, and wherein said pump means is a staged pump means in which the reciprocable pumping member causes fluid to be drawn into a first chamber located adjacent one side thereof and fluid to be expelled from a second chamber adjacent its other side during the first stroke and wherein fluid is caused to flow from the first chamber to the second chamber via one-way check valves carried by the pumping member when the latter is moved through its second stroke.

The present invention further resides in various novel constructions and arrangement of parts, and further objects, novel characteristics and advantages of the present invention will be apparent to those skilled in the art to which it relates and from the following detailed description of the illustrated, preferred embodiments thereof made with reference to the accompanying drawings forming a part of this specification and in which similar reference numerals are employed to designate corresponding parts throughout the several views, and in which.

The present invention provides a novel pump assembly and in particular a novel vacuum pump assembly which is actuated by pressure pulsations in exhaust gases emanating from an internal combustion engine.

Figure 1:
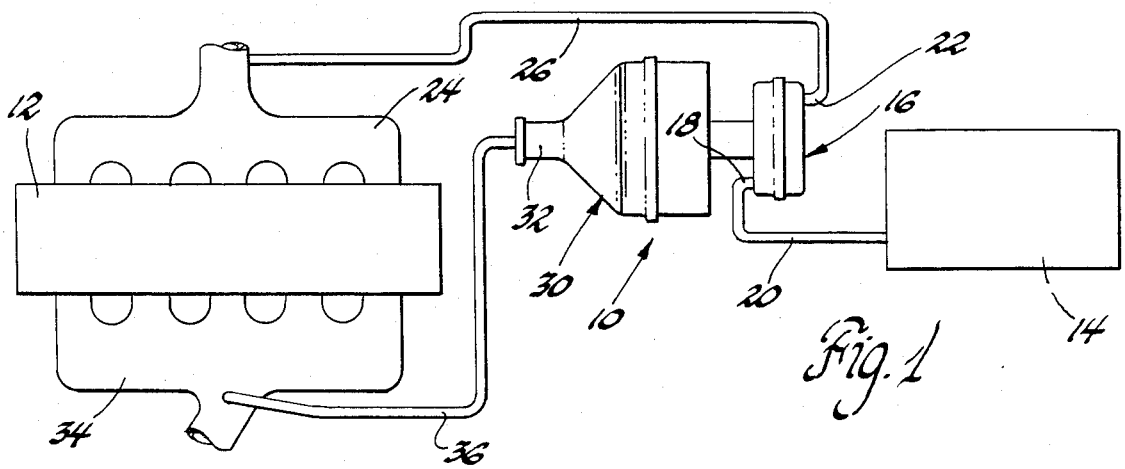
FIG. 1 is a schematic diagram illustrating the novel vacuum pump assembly of the present invention and its interconnection with an internal combustion engine and a vacuum source.

Referring to the schematic diagram of FIG. 1, a vacuum pump assembly 10 is there schematically shown as being interconnected with an internal combustion engine 12 and a vacuum source or storage tank 14. The vacuum pump assembly 10 includes a pump means 16 whose inlet 18 is connected with the vacuum source 14 via a conduit 20 and whose outlet 22 is preferably connected with an intake manifold 24 of the internal combustion engine 12 via a conduit 26. The pump means 10 also includes an actuating means 30 having an inlet 32 which is in communication with an exhaust gas manifold 34 of the internal combustion engine 12 via a conduit 36.

The internal combustion engine 12, as diagrammatically illustrated in FIG. 1, is a four-cylinder internal combustion engine. It should be understood, however, that other size multi-cylinder engines could be employed. The vacuum source 14 is illustrated as being a reservoir having a predetermined volume. It should be understood, however, that instead of the reservoir, the vacuum source could be the combined volume necessary to operate a conventional brake booster housing, EGR valve, cruise control, or any other pneumatically operated control or device requiring a vacuum pressure.

It should be noted at this point that studies of the pressure profile of exhaust gases for a multicylinder internal combustion engine show that the exhaust gases emanate as pressure pulsations whose pressure, frequency and amplitude, when approximated to a cyclic sine wave, vary greatly in accordance with engine speed and operating conditions. The pressure profiles will also vary somewhat in accordance with the size and number of cylinders of the internal combustion engine, the configuration of the exhaust system and the location within the exhaust system where the pressure profiles are measured. In the illustrated schematic view of FIG. 1, the exhaust gas pressure pulsations for use with the novel pump assembly 10 are preferably taken from a location adjacent the outlet of the exhaust gas manifold 34. It will, of course, be understood that in some pump applications other locations for picking up exhaust gas pressure pulsations may be more desirable.

It has been found that the frequency of the cyclic operation of exhaust gas pressure pulsations is typically on the order of 30 to 150 Hertz. The amplitude of the pressure pulsations is great enough so that subatmospheric pressures usually exist during a portion or short period of each cycle of the exhaust gas pulsations even though the average pressure during the cycle is substantially above atmospheric pressure. In typical internal combustion engine exhaust systems, the subatmospheric pressure periods occur to varying degrees during most engine speeds, but disappear entirely at higher engine speeds and loads wherein the pressure pulsations during their entire cycle are at above atmospheric pressure.

Figure 2A:
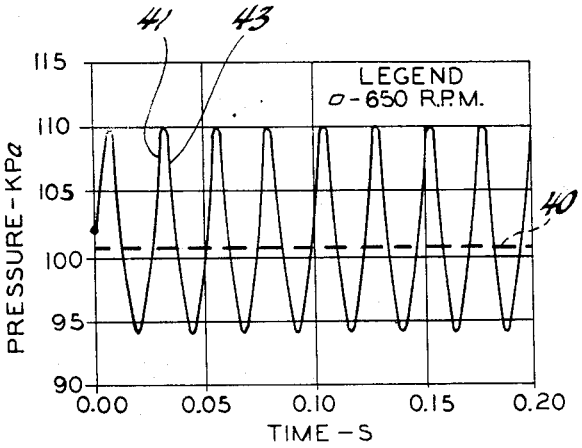
FIGS. 2A through 2D are graphs of exhaust gas pressure profiles, when approximated to a cyclic sine wave, of exhaust gases of an internal combustion engine at different engine speeds.
Figure 2B:
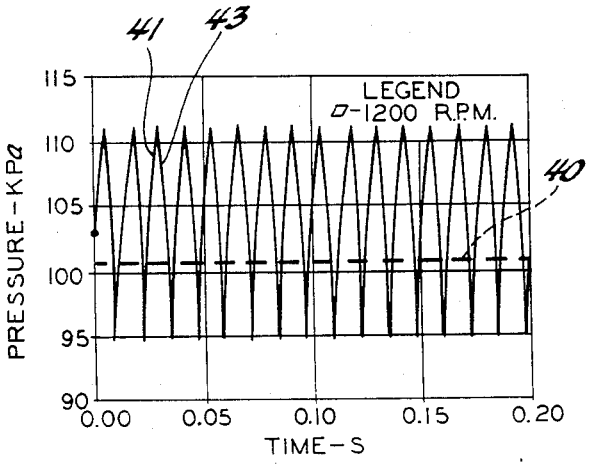
Figure 2C:
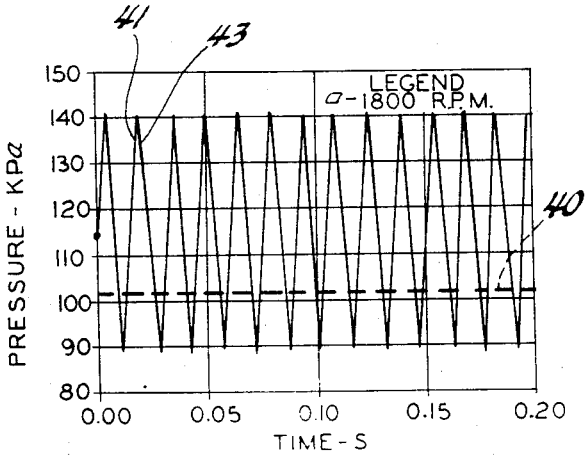
Figure 2D:
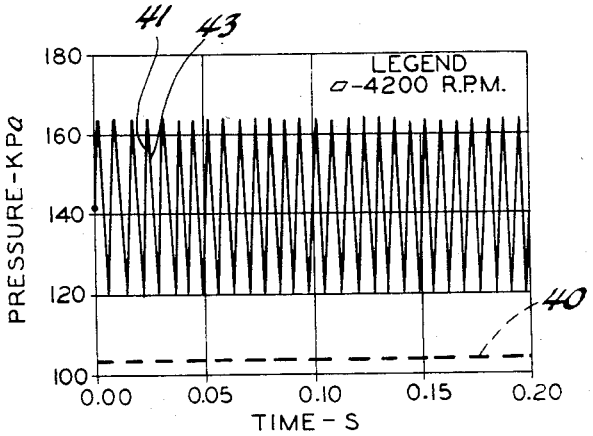

As an illustrative example, FIGS. 2A through 2D show the exhaust gas pressure profiles, when approximated to a sine wave, of the exhaust gases of a 2.5 liter four-cylinder internal combustion engine. FIG. 2A illustrates the exhaust gas pressure profile at idle (approximately 650 rpm), FIG. 2B illustrates exhaust gas pressure profile at approximately 1200 rpm and one-half load, FIG. 2C illustrates exhaust gas pressure profile at approximately 1800 rpm and high load or wide open throttle, and FIG. 2D shows the exhaust gas pressure profile at approximately 4200 rpm and full load or wide open throttle. The vertical side of each of the graphs illustrates the pressure in kPA and the horizontal side indicates time in seconds. Atmospheric pressure is at approximately 101 kPA as is illustrated by the horizontally extending dotted line 40 on each of the graphs 2A to 2D.

As can be seen from FIG. 2A, the exhaust gas pressure pulsations at approximately idle speed have an amplitude which varies between 95–110 kPA and a frequency of approximately two cycles for each 0.05 seconds. At approximately 1200 rpm (FIG. 2B), the pressure variance in the pressure pulsations remains approximately the same as it was at idle speed, but the frequency of the pressure pulsation cycles is approximately twice that experienced at idle speed. At 1800 rpm (FIG. 2C), the pressure of the pressure pulsations varies between approximately 90–140 kPA, but the frequency of the pulse cycle decreases slightly from that shown at 1200 rpm (FIG. 2B). At 4200 rpm (FIG. 2D), the pressure pulsations vary between approximately 120–160 kPA and the frequency of the pulse cycles is approximately double that shown at 1800 rpm (FIG. 2C).

Each cycle for each pressure pulsation can be defined as having a pressure increasing phase 41 and a pressure decreasing phase 43 and with each cycle constituting a single frequency. As can be seen from the graphs of 2A to 2C, for each cycle of operation of each pressure pulsation, a portion or short period of each cycle occurs at a pressure which is below atmospheric pressure as indicated by the dotted line 40. These subatmospheric pressure periods occur to a progressively lesser degree as the engine speed increases up to an engine speed in excess of 1800 rpm. But, as the graph of FIG. 2D illustrates, such subatmospheric pressure periods totally disappear at high engine speeds and loads, such as at 4000–4200 rpm. At engine speeds somewhat higher than 1800 rpm to maximum and high loads, the entire cycle of operation for each pressure pulsation takes place at a pressure substantially above atmospheric pressure.

From the above, it should be apparent that in order to utilize exhaust gas pressure pulsations as the motive force to operate a vacuum pump assembly over a wide range of engine speeds and loads, the pump assembly must be designed to operate even though the pressure of the pressure pulsations varies widely and during engine speeds and loads when the pressure pulsations include subatmospheric periods and when the pressure pulsations during their entire cycle are wholly above atmospheric pressure.

Figure 3:
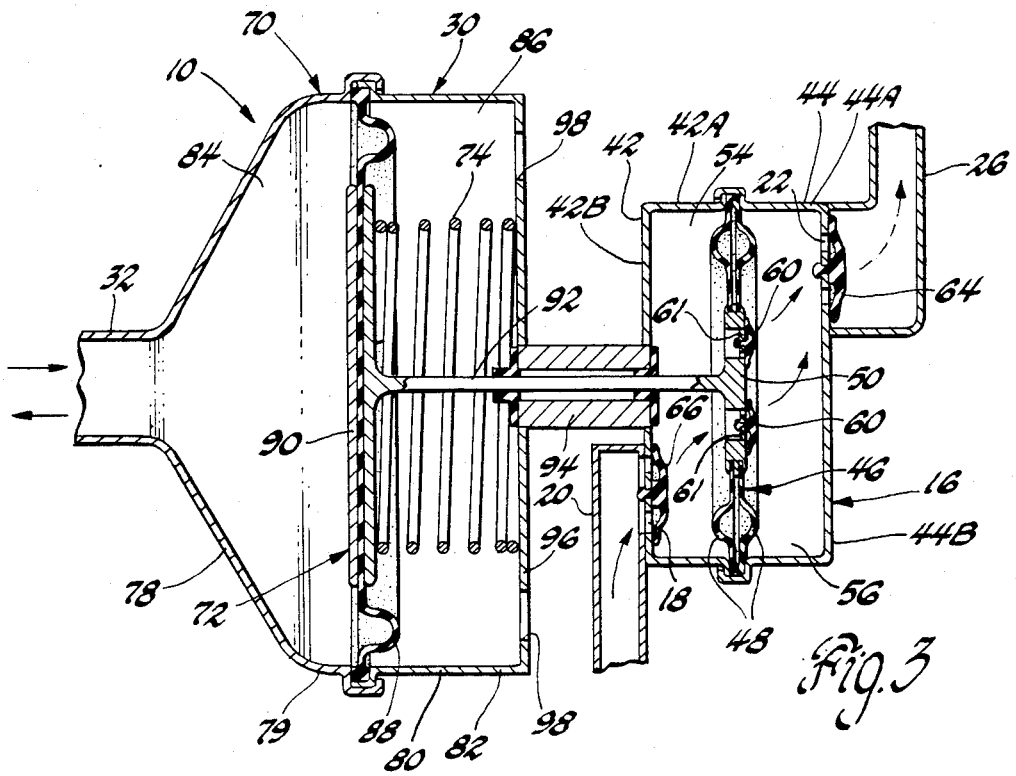
FIG. 3 is a schematic view with part shown in section and part shown in elevation of one embodiment of the novel pump assembly of the present invention.

Referring to FIG. 3, one embodiment of the novel pump assembly 10 is thereshown. The pump assembly 10 comprises the pump means 16 for pumping air from the vacuum source 14 to the intake manifold 24. The pump means 16 is a staged pump having a one to one pumping ratio and comprises a pair of cup-shaped pump housings 42 and 44 and a reciprocable diaphragm assembly 46. The cup-shaped pump housings 42 and 44 are stamped from sheet metal and respectively include cylindrical side walls 42A and 44A and bottoms 42B and 44B at one end of the side walls 42A and 44A. The side walls 42A and 44A of the housing adjacent their free ends are suitably crimped together to form a housing means.

The diaphragm assembly 46 includes a pair of oppositely facing juxtaposed flexible diaphragms 48 which are sealably secured at their inner periphery to an annular rigid plate or member 50 and at their outer periphery sealably secured between the crimped ends of the housings 42 and 44. The diaphragm assembly 46 divides the pump housing into a pair of chambers 54 and 56 and the rigid member 50 carries a plurality of one-way check valves 60. The check valves 60 are in the form of umbrella valves 60 made from a suitable elastomeric material. The umbrella valves 60 are normally self-biased toward a position in which they overlie through openings 61 in the member 50, but are deflectable to allow fluid to flow from chamber 54 to chamber 56 when the diaphragm assembly 46 is moved to the left, as viewed in FIG. 3.

Communication between pump chamber 56 and outlet conduit 26 via outlet 22 is controlled by a one-way check valve means 64. To this end, the bottom 44B of the housing 44 has openings therethrough which defines the outlet 22 and the check valve 64 is in the form of a flexible umbrella valve carried by the bottom 44B. The umbrella valve 64 is made from a suitable elastomeric material and is self-biased toward a position in which it overlies outlet 22 and seals chamber 56 from communication with conduit 26. The umbrella valve 64 is deflectable to allow fluid to flow from chamber 56 to the conduit 26 when the pressure in chamber 56 exceeds the pressure in conduit 26.

Communication between pump chamber 54 and conduit 20 via inlet 18 is controlled by a one-way check valve means 66. To this end, the bottom 42B of the housing member 42 has openings therethrough which defines the inlet 18 and the check valve 66 is in the form of a flexible umbrella valve carried by the bottom 42B. The umbrella valve 66 is made from a suitable elastomeric material and is self-biased toward a position in which it overlies the openings 18 to prevent communication between the conduit 20 and chamber 54. The check valve 66 is deflectable to allow fluid to flow from conduit 20 through inlet 18 into chamber 54 when the pressure in conduit 20 exceeds the pressure in chamber 54.

It should be apparent from the above that when the diaphragm assembly 46 is moved or flexed through its first stroke or to the right, as viewed in FIG. 3, the pressure in chamber 54 will decrease and the pressure in chamber 56 will increase. During this movement, the umbrella valve 66 will open to allow fluid to flow from conduit 20 through inlet 18 into chamber 54 and at some point during the rightward movement through its first stroke the umbrella valve 64 will open to allow fluid to be expelled from chamber 56 into conduit 26. During this movement no flow of fluid from chamber 56 can flow into chamber 54 because the umbrella check valves 60 will at all times be in their closed position. Likewise when the diaphragm assembly 46 is moved through its second stroke or toward the left, as viewed in FIG. 3, the pressure in chamber 56 will decrease and the pressure in chamber 54 will increase. This will cause the umbrella valve 64 to be moved to its closed position and prevent communication between conduit 26 and chamber 56 and will also cause umbrella valve 66 to be moved to its closed position to prevent communication between conduit 20 and chamber 54. However, during this leftward movement, fluid will flow from chamber 54 to chamber 56 via the check valves 60. That is, when the pressure in chamber 54 exceeds the pressure in chamber 56 the umbrella valve 60 will open to allow fluid to flow from chamber 54 to chamber 56.

It should be noted at this point, that the diaphragm assembly 46 could be replaced by a reciprocable piston assembly having an outer annular seal which slidably engages a cylindrical sleeve or liner located inside of the cylindrical housing portions 42A and 44A of the housing means 42. In such a structure, the piston assembly would include one-way check valve means like the check valves 60.

The diaphragm assembly 46 is adapted to be reciprocated through its first and second strokes by the actuating means 30. The actuating means 30 comprises a housing means 70, a diaphragm assembly 72 drivingly connected with a diaphragm assembly 46 and a variable rate spring means 74. The housing means 70 is stamped from sheet metal and comprises a generally frusto-conically shaped housing member 78 whose annular side wall 79 adjacent its open or wide end is suitably crimped to a cylindrically shaped side wall 80 of a cup-shaped housing member 82. The diaphragm assembly 72 divides the housing means 70 into a pair of chambers 84 and 86 and includes a flexible diaphragm 88 whose outer periphery is clamped between the housing members 78 and 82 and whose inner periphery is secured to a rigid annular member 90. The rigid member 90 is drivingly connected to the rigid member 50 of the diaphragm assembly 46 of the pump means 14 by a shaft 92. The shaft 92 is slidably received in an annular bearing means 94 whose opposite ends are secured to the housings 82 and 42. The bearing means 94 includes suitable bearing surfaces or bearings and suitable seals and slidably receives the shaft 92 for reciprocable movement in opposite directions.

The diaphragm assembly 72 is normally biased to a normal position, as shown in FIG. 3, by the variable rate spring means 74. The variable rate spring means 74 is a coiled spring which has one end in abutting engagement with a bottom planar wall 96 of the housing 82 and its other end in abutting engagement with the rigid member 90 of the diaphragm assembly 72. The chamber 86 of the housing 82 is vented at all times to the atmosphere via vent holes 98. The chamber 84 of the actuating means 30 is at all times in communication with the exhaust gases of the internal combustion engine 12 via the conduit 36 and the inlet 32, the latter shown as being formed integral with the housing 78.

Based on studies using a mathematical model, the approximate dimensions of the pump assembly components for a design appropriate for a typical four-cylinder engine for use with a passenger car are as follows:

Diameter of diaphragm assembly 72=0.090 meters.

Diameter of reciprocable diaphragm assembly 46=0.0636 meters.

Preload of variable rate spring 74=0.0 newtons.

Flow areas of the check valve means 62, 66 and 60=0.0001556 meters$^2$.

Volume of chamber 84 (=0.0000687 meters$^3$).

Volume of chamber 54 (initial)=0.00000076 meters$^3$.

Volume of chamber 56 (initial)=0.000042 meters$^3$.

Maximum stroke of diaphragm assembly 46=0.013 meters.

In operation, as exhaust gases flow from the exhaust gas manifold 34 a portion thereof will be directed via conduit 36 to inlet 32 and enter chamber 84 of the actuating means 30. Since the exhaust gases emanate as pressure pulsations, the latter during their pressure increasing phase of each pulse cycle will act on the diaphragm assembly 72 to cause movement of the latter toward the right or through its first stroke, as viewed in FIG. 3, and in opposition to the biasing force of the spring means 74. When the sum of the pressure in volume 84 times the area of the diaphragm assembly 72 and the pressure in volume 54 times the area of the diaphragm assembly 46 is greater than the sum of the pressure in chamber 56 times the area of the diaphragm assembly 46, atmospheric pressure times the diaphragm assembly 72 and the force of the spring 74, and any friction and resistance to movement, then the diaphragm assembly 72 will tend to move rightward through its first stroke and cause an increase in the pressure of chamber 56 and a decrease in the pressure of chamber 54. This movement of the diaphragm assemblies 72 and 46 toward the right through their first stroke will cause the umbrella valve 66 to open to cause fluid to be drawn from conduit 20 into chamber 54 and cause umbrella valve 64 to open to cause fluid from chamber 56 to be expelled into conduit 26. This rightward movement of the diaphragm 42 and 76 continues during the pressure increasing phase of the pulse cycle until the peak pressure is reached. At that point the pressure in chamber 84 begins to decrease as the pulse enters its pressure decreasing phase.

It should be noted at this juncture that whenever the diaphragm assemblies 46 and 72 are moved through their strokes that some slight additional movement will normally take place beyond their position at the time the pulse cycle is at its peak or bottom. This is due to inertia forces or effects acting on the diaphragm assemblies 46 and 72 and the piston rod 92. For the sake of brevity, this inertia effect will not be repeated in the operational description of the pump assemblies which follows.

During the pressure decreasing phase of each pressure pulsation or cycle, the spring means 74 will begin to move the diaphragm assemblies 72 and 46 toward the left or through its second stroke, as viewed in FIG. 3. This leftward movement occurs when the pressure exerted by the spring means 74, the pressure in chamber 86 times the area of the diaphragm assembly 72 and the pressure in chamber 56 times the area of the diaphragm 46 exceeds the sum of the pressure in chamber 54 times the area of the diaphragm assembly 46 and the pressure in chamber 84 times the area of the diaphragm assembly 72 and any frictional resistance to movement. As the diaphragm assemblies 72 and 46 move toward the left, umbrella check valve 66 will move to its closed position to prevent further communication between conduit 20 and chamber 54, the umbrella valve 64 will move to its closed position to prevent communication between conduit 26 and chamber 56 and the umbrella check valves 60 will move from their closed position to an open position to cause fluid to flow from chamber 54 to chamber 56. This movement continues until the decreasing pressure phase of each pressure pulsation or cycle reaches its lowest value.

From the foregoing, it can be seen that the pump means 16 is a staged pump means in which fluid is alternately drawn into and expelled from chamber 56. This means that pumping action from chamber 56 to conduit 26 only occurs on alternate strokes of the pump.

It should be noted that leftward movement of the diaphragm assemblies 72 and 46, as viewed in FIG. 3, is aided during the decreasing pressure phase portion of each pulsation when the latter is at subatmospheric pressure. This is because the pressure in chamber 86 times the area of the diaphragm 72 will exceed the pressure in chamber 84 times the area of the diaphragm 72 and thus, leftward movement is aided as a result of the subatmospheric period during the pressure pulses. As noted hereinbefore, these subatmospheric periods of each pressure pulsation occur during engine speeds up to and slightly above 1800 rpm. This, however, does not occur at high engine speeds and loads where the pressure of the pressure pulses is at all times above, atmospheric pressure.

It should also be noted that the variable rate spring means 74 is an important feature of the present invention in that it provides little resistance to movement of the diaphragm assembly 72 through its first strokes during low and moderate engine speeds. This allows the pump to operate at a sufficient displacement stroke during these speeds so as to enable a good pumping action to be obtained. However, at the higher engine speeds, the force exerted by the spring means 74 progressively increases so that it can cause movement of the diaphragm assembly 72 through its second stroke even though the exhaust gas pulsations are at all times above atmospheric pressure. The variable rate spring means 74 is designed so that little resistance to deflection occurs during a first given linear distance of deflection and then progressively steeply increases its resistance to further deflection upon further linear deflection of the spring. This type of spring is to be contrasted with a constant rate spring whereby the resistance to deflection by the spring increases at a linear rate with the amount of deflection.

The linear displacement of the diaphragm assemblies 72 and 46 and the frequency of their strokes varies greatly at different engine speeds. During low engine speeds up to approximately 1200 rpm, the diaphragm assemblies 72 and 46 tend to be deflected back and forth adjacent the left end of their respective housings at relatively low frequencies through relatively short strokes. At medium engine speeds, such as 1800 rpm, the diaphragm assemblies 72 and 46 are deflected through a large displacement approaching the maximum of 0.13 meters and at a medium frequency. During high engine speeds and loads, the diaphragm assemblies 72 and 46 are deflected back and forth adjacent the right end of their respective housings, as viewed in FIG. 3, at a high frequency through relatively short strokes.

Figure 4:
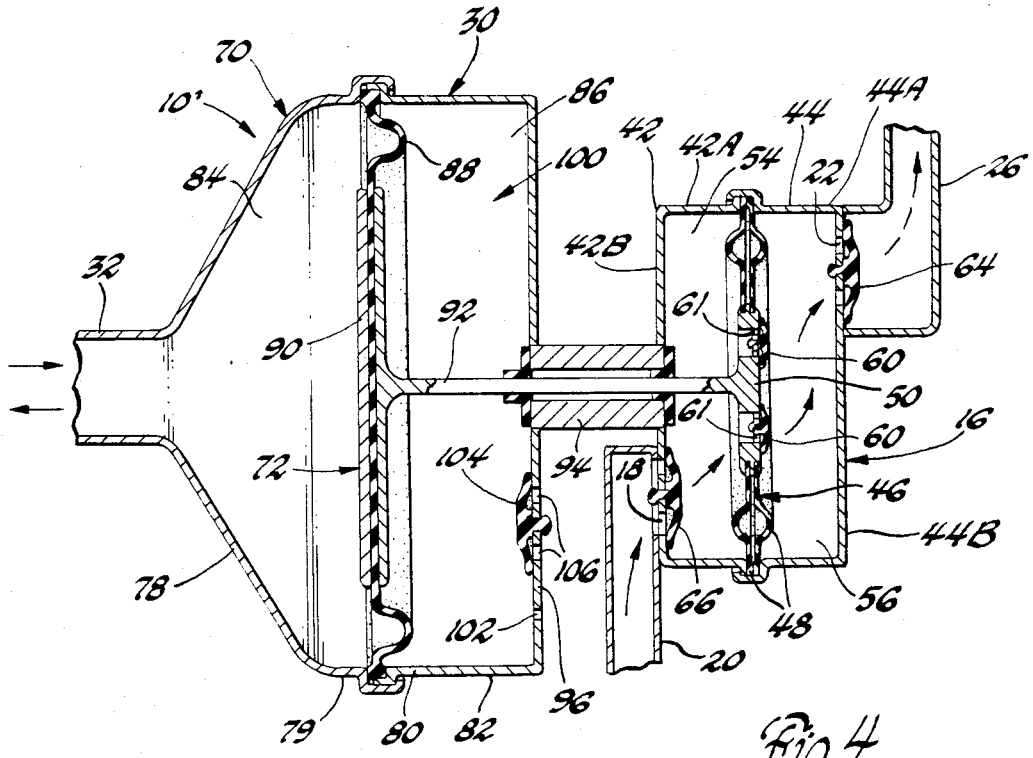
FIG. 4 is a view substantially identical to that shown in FIG. 3 except that a different return spring means is employed.

Referring to FIG. 4, a novel pump assembly 10' is thereshown which is identical to the pump assembly 10 shown in FIG. 3 except that a variable rate air spring means 100 is employed instead of the variable rate mechanical spring means 74 of the pump assembly 10 shown in FIG. 3. The parts of the pump assembly 10' which correspond to the parts of the pump assembly 10 are given the same reference numerals. In the pump assembly 10', the cup-shaped housing 82 is normally closed and sealed from the atmosphere, except for a small bleed hole 102 in its bottom 96. The housing 82 and diaphragm assembly together define the variable rate air spring 100 having a non-linear spring rate. The bleed hole 102 is small enough not to significantly affect the operation of the air spring 100 and is provided to allow the air in the air spring 100 to be at the same temperature and pressure as the ambient atmosphere when diaphragm assembly 72 is in its leftmost rest position.

In addition, a one-way check valve means 104 carried by the bottom 96 of the housing 82 is provided. The check valve means 104 is of an identical construction to the check valve means 64 and includes a flexible umbrella valve normally self-biased to a closed position in which it engages the bottom 96 and overlies through openings 106 in the bottom 96. The check valve means 104 is movable to an open position to allow ambient air to flow into the chamber 86 whenever the pressure of the fluid in chamber 86 is below the ambient pressure, such as can occur when the diaphragm assembly 72 is moved leftwardly, as viewed in FIG. 4, under certain operating conditions of the pump assembly. This insures that the fluid pressure of the air spring 100 is always at or above atmospheric pressure.

The pump assembly 10' shown in FIG. 4 operates in the same manner as that previously described with respect to the pump assembly 10 shown in FIG. 3 except that the air spring 100 acts as a variable rate spring means in place of the variable rate mechanical spring means.

Figure 5:
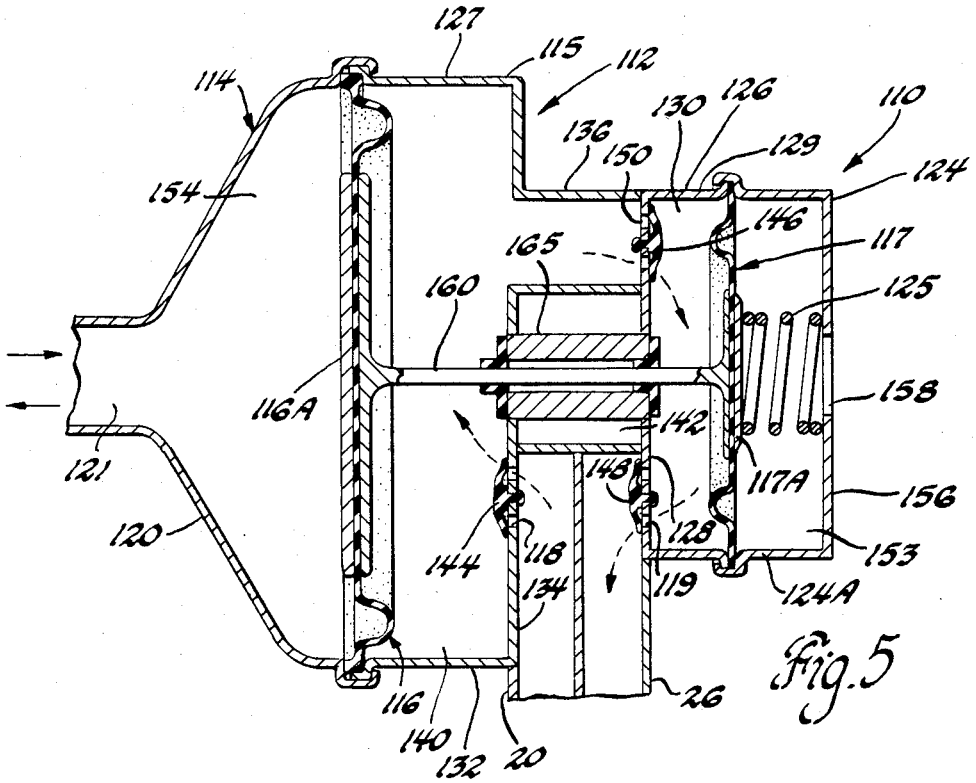
FIG. 5 is a schematic with part shown in section and part shown in elevation of another embodiment of the novel pump assembly of the present invention.

Referring to FIG. 5, an alternate embodiment of a novel pump assembly 110 of the present invention is thereshown. The pump assembly 110 comprises a combined two-stage pump means 112 and actuating means 114 To this end, the pump means 112 comprises a housing means 115, a pair of deflectable diaphragm assemblies 116, 117 forming end walls for the housing means 115, an inlet 118 and an outlet 119. The actuating means 114 includes a first housing means 120 having an inlet 121 at one end which is connected with conduit 32 and with the diaphragm assembly 116 forming an end wall at its other end. The pump means 112 also includes a cup-shaped housing means 124 which has the diaphragm assembly 117 as one end wall and which houses a variable rate spring means 125.

The pump housing means 115 comprises first and second housing members 126 and 127 stamped from sheet metal. As viewed in FIG. 5, the housing member 126 is cup-shaped and includes an annular, radially extending bottom wall 128 at its left end and an annular side wall 129 whose free or right end is crimped to an annular side wall 124A of the housing means 124 and in a manner in which the outer periphery of the diaphragm assembly 117 is clamped therebetween. The housing member 126, bottom wall 128 and diaphragm assembly 117 define a chamber 130. The housing member 127 has an annular side wall portion 132, a radially extending bottom wall portion 134 and an axially extending arcuately shaped tubular portion 136 extending from the bottom wall portion 134 and secured to the bottom wall 128 of housing member 126. The side wall portion 132, bottom wall portion 134, tubular portion 136, bottom wall 128 of housing member 126 and the diaphragm assembly 116 define a chamber 140, which preferably has a volume twice that of the volume of chamber 130. The tubular portion 136 and spaced bottom walls 134 and 128 define a recess 142 through which the inlet and outlet conduits 20 and 26 extend.

Communication between the inlet conduit 20 and the chamber 140 is controlled by a one-way check valve means 144. Communication between chamber 140 and chamber 130 is controlled by one-way check valve means 146 and communication between chamber 130 and outlet conduit 26 is controlled by one-way check valve means 148. The check valve means 144, 146 and 148 include one or more flexible umbrella valves made from a suitable elastomeric material. The check valve means 144 is normally self-biased to a closed position in which it overlies a plurality of through openings defining the inlet 118 in the bottom wall portion 134 of the housing member 127, but is movable to an open position in which it uncovers the inlet 118 when the pressure in the conduit 20 is greater than the pressure in the chamber 140. The check valve means 146 is normally self-biased to a closed position in which it overlies a plurality of through openings 150 in the bottom wall 128 of housing 126, but is movable to an open position when the pressure in chamber 140 is greater than the pressure in chamber 130. The check valve means 148 is normally self-biased to a closed position in which it overlies a plurality of through openings defining the outlet 119 in the bottom wall 128 of the housing 126, but is movable to an open position when the pressure in chamber 130 is greater than the pressure in outlet conduit 26.

The housing 120 of the actuating means 114 is a stamped metal housing generally frusto-conical in shape and has an inlet 121 at one end which is connected to conduit 36 so as to be in communication with the exhaust gases. The housing 120 at its other end is suitably crimped to the left end of the side wall 132 of the housing 127, as viewed in FIG. 5, and in a manner in which the diaphragm assembly 116 at its outer periphery is clamped therebetween. The housing 120 and diaphragm assembly 116 define a chamber 154. The cup-shaped housing 124 defines a chamber 153 and includes a radially extending bottom wall 156 at its right end, as viewed in FIG. 5. The bottom wall 156 has an opening 158 therethrough to communicate the chamber 153 to the atmosphere.

The variable rate spring means 125 is a non-linear variable rate spring and is in the form of a variable rate coil spring having one end in abutting engagement with the bottom wall 156 of the housing 124 and its other end in abutting enagement with a central rigid portion 117A of the diaphragm assembly 117.

The diaphragm assemblies 116 and 117 are drivingly connected together for simultaneous reciprocable movement through first and second or back and forth strokes by a rigid piston rod 160 whose opposite ends are suitably secured to the central portion 117A of the diaphragm assembly 117 and a central rigid portion 116A of the diaphragm assembly 116.

The piston rod 160 is slidably guided during its reciprocable movement by a bearing and shaft seal assembly 165, the latter being secured to and carried by the bottom walls 134 and 128 of the housings 127 and 126, respectively.

When the pump assembly 110 is not being operated, the spring means 125 biases the diaphragm assemblies 116 and 117 to a position leftward of the position shown in FIG. 5. Based on studies using a mathematical model, the approximate dimensions of the components of the pump means 110 for use with a typical four-cylinder engine for a passenger car should be as follows:

Diameter of diaphragm assembly 116=0.090 meters.

Diameter of diaphragm assembly 117=0.0636 meters.

Preload of spring 125=0.0 newtons.

Flow areas of each of the check valves 144, 146 and 148=0.0001556 meters$^2$.

Volume of chamber 154 (initial)=0.0000687 meters$^3$.

Volume of chamber 140 (initial)=0.000083 meters$^3$.

Volume of chamber 130 (initial)=0.00000076 meters$^3$.

Maximum stroke of the diaphragm assembly 117=0.013 meters.

In operation, a portion of the exhaust gases emanating from the internal combustion engine 12 are caused to flow via conduit 36 and inlet 121 into chamber 154. The fluctuating pressures of the exhaust gases in the chamber 154 acts on the diaphragm assembly 116 and tends to cause rectilinear motion of the diaphragm assembly 116, which in turn causes rectilinear motion of the diaphragm assembly 117 of the pump means 112. During the pressure increasing phase of each exhaust gas pressure pulsation in the chamber 154, the diaphragm assembly 116 is caused to be moved toward the right or through its first stroke, as viewed in FIG. 5. This is due to the fact that the sum of the pressures in chamber 154 times the area of the diaphragm assembly 116 and the pressure in chamber 130 times the area of the diaphragm assembly 117 is greater than the sum of the pressures in chamber 140 times the area of the diaphragm assembly 116, atmospheric pressure times the area of the diaphragm assembly 117, the biasing force of the spring means 125, and any friction. As the diaphragm shaft assemblies 116 and 117 move rightward, as shown in FIG. 5, they cause a decrease in pressure in chamber 130 and an increase in pressure in chamber 140. This causes air to flow from chamber 140 past check valve 146 into chamber 130. This rightward movement of the diaphragm assemblies 116 and 117 occurs until the peak of the increasing pressure phase of the pressure pulsation is reached. When this occurs, the diaphragm shaft assemblies 116 and 117 are caused to be moved to the left or through their second stroke, as viewed in FIG. 5. This is because as the pressure decreases in chamber 154, the spring means 125 will move the diaphragm assemblies 116 and 117 toward the left. This movement will cause air to be expelled from chamber 130 past check valve 148 into conduit 26 and air to be drawn from conduit 20 past check valve 144 into chamber 140. This movement continues until the decreasing pressure phase of each pressure pulsation reaches its bottom wherein the cycle will be repeated.

The variable rate spring 125 is substantially identical to the spring 74 of FIG. 3 and functions in the same manner as that previously described for spring 74.

Figure 6:
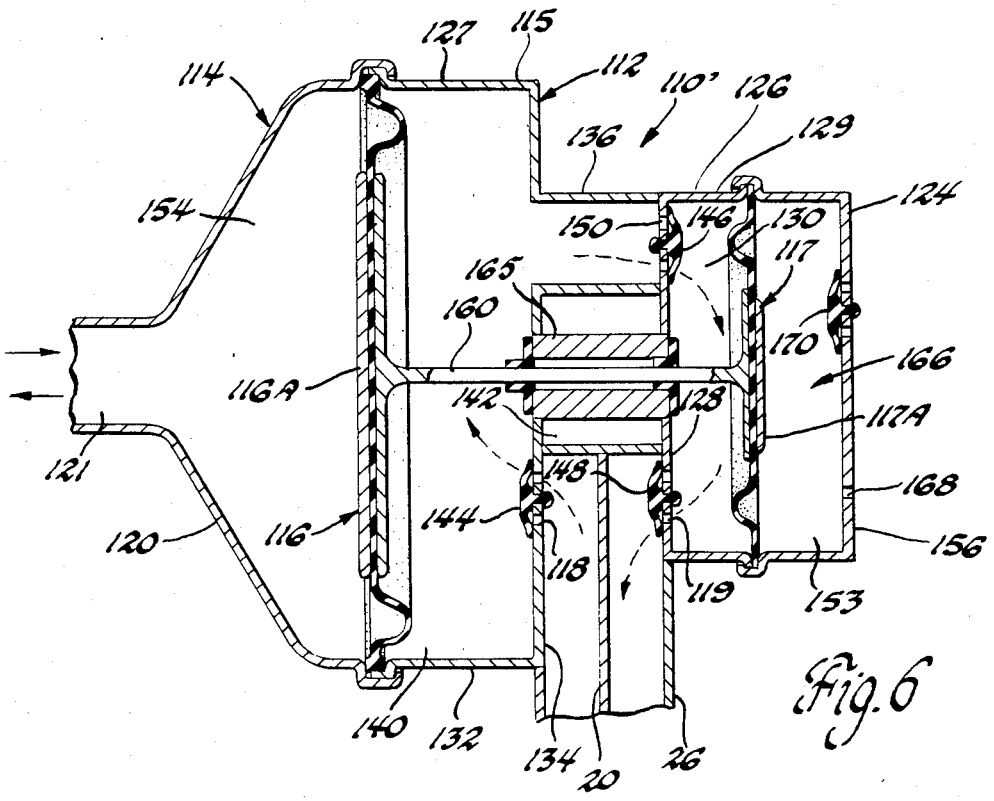
FIG. 6 is a view substantially identical to the view shown in FIG. 5 except that a different return spring means is employed.

FIG. 6 shows an identical pump assembly 110' to that shown in FIG. 5 except that no mechanical spring means is employed and that the chamber 153 is closed to the atmosphere to define a non-linear, variable rate air spring 166 instead. A small bleed hole 168 in the bottom wall 156 of the housing 124 is provided to compensate for ambient pressure variations. Also, a check valve means 170 is carried by the housing 124, and for the same reasons as previously described in connection with the pump assembly 110 shown in FIG. 5. In other respects the pump assembly 110' is identical to that previously described in connection with the pump assembly 110 of FIG. 5. The operation of the pump assembly 110' is identical to the operation of the pump assembly 110 of FIG. 5 and with the air spring 166 providing the same function as the mechanical spring 125 described in connection with the pump assembly 110.

From the foregoing, it should be apparent that novel pump assemblies have been provided which can be driven by the exhaust gases of an internal combustion engine throughout a wide range of engine operating conditions and that by the inclusion of a non-linear, variable rate spring means, the pump means will operate irrespective of whether the pressure pulsations include any portion in their cycles which is at a pressure below atmospheric or whether the pressure pulsations at all times during their cycles of operation are at above atmospheric pressure. Mathematical studies have indicated that the novel pump assemblies should provide sufficient pumping action to supply the necessary vacuum to operate a car's pneumatic controls, such as a brake booster housing, during medium to high speeds and to provide sufficient vacuum in conjunction with the vacuum supplied by the intake manifold at low and moderate engine speeds.

While the novel pump assemblies of the present invention have been described as being used as a vacuum pump assembly for use with internal combustion engines, it should be apparent to those skilled in the art that the novel pump assemblies could be used to pump a fluid under positive pressure, such as compressed air, etc. Examples of such uses would be for providing compressed air for air shock or air springs in leveling controls and/or for use in pumping a liquid washer fluid onto a windshield or headlamp of an automobile.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property or privilege is claimed are defined as follows:

1. In combination, a pump assembly and an internal combustion engine which generates exhaust gases having pressure pulsations of varying pressure, frequency and amplitude at different engine speeds, said pump assembly comprising:

a pump means for pumping a fluid and including a reciprocable pumping member movable through first and second strokes, an actuating means including a reciprocable actuating member movable through first and second strokes and which is connected to said pumping member to move the same through its first and second strokes, one side of said actuating member being in communiation with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said spring means having a non-linear variable spring rate which exerts a progressively higher biasing force as the pressure of the exhaust gas pulsations increases with increasing engine speed whereby said pump assembly is operable to pump said fluid over a wide range of engine speeds and during engine speeds when portions of the amplitude of the pressure pulsations are at subatmospheric pressure and during engine speeds when the entire amplitude of the pressure pulsations is wholly above atmospheric pressure.

2. In combination, a vacuum pump assembly and an internal combustion engine which generates exhaust gases having pressure pulsations of varying pressure frequency and amplitude at different engine speeds, said pump assembly comprising:

a pump means for pumping air from a source to create a negative pressure at the source and which includes a reciprocable pumping member movable through first and second strokes, said pump means having an outlet which is adapted to be connected to an intake manifold of said engine, an actuating means including a reciprocable actuating member movable through first and second strokes and which is connected to said pumping member to move the same through its first and second strokes, one side of said actuating member being in communication with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said spring means having a non-linear variable spring rate which exerts a progressively higher biasing force as the pressure of the exhaust gas pulsations increases with increasing engine speed whereby said pump assembly is operable to pump said air over a wide range of engine speeds and during engine speeds when portions of the amplitude of the pressure pulsations are at subatmospheric pressure and during engine speeds when the entire amplitude of the pressure pulsations is wholly above atmospheric pressure.

3. In combination, a vacuum pump assembly and an internal combustion engine which generates exhaust gases having pressure pulsations of varying pressure, frequency and amplitude at different engine speeds, said pump assembly comprising:

a pump means for pumping air from a source to create a negative pressure at the source and which includes a reciprocable pumping member movable through first and second strokes, said pump means having an outlet which is adapted to be connected to an intake manifold of said engine, an actuating means including a reciprocable actuating member movable through first and second strokes and which is connected to said pumping member to move the same through its first and second strokes, one side of said actuating member adapted to be in communication with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and mechanical spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said mechanical spring means having a non-linear variable spring rate which exerts a progressively higher biasing force as the pressure of the exhaust gas pulsations increases with increasing engine speed whereby said pump assembly is operable to pump said air over a wide range of engine speeds and during engine speeds when portions of the amplitude of the pressure pulsations are at subatmospheric pressure and during engine speeds when the entire amplitude of the pressure pulsations is wholly above atmospheric pressure.

4. In combination, a vacuum pump assembly and an internal combustion engine which generates exhaust gases having pressure pulsations of varying pressure, frequency and amplitude at different engine speeds, said pump assembly comprising:

a pump means for pumping air from a source to create a negative pressure at the source and which includes a reciprocable pumping member movable through first and second strokes, said pump means having an outlet which is adapted to be connected to an intake manifold of said engine, an actuating means including a reciprocable actuating member movable through first and second strokes and which is connected to said pumping member to move the same through its first and second strokes, one side of said actuating member being in communication with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and an air spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said air spring means having a non-linear variable spring rate which exerts a progressively higher biasing force as the pressure of the exhaust gas pulsations increases with increasing engine speed whereby said pump assembly is operable to pump said air over a wide range of engine speeds and during engine speeds when portions of the amplitude of the pressure pulsations are at subatmospheric pressure and during engine speeds when the entire amplitude of the pressure pulsations is wholly above atmospheric pressure.

5. In combination, a vacuum pump assembly and an internal combustion engine which generates exhaust gases having pressure pulsations of varying pressure, frequency and amplitude at different engine speeds and which has an intake manifold, said pump assembly comprising:

a staged pump means for pumping air from a source to the intake manifold to crease a negative pressure at the source, said pump means including a housing, a reciprocable pumping member movable relative to the housing through first and second strokes and which divides the housing into first and second chambers on opposite sides of the pumping member, said first chamber being in communication with said source via first one-way check valve means and said second chamber being in communication with said intake manifold, said pumping member carrying second one-way check valve means for controlling communication between said first and second chambers, said pumping member causing air to be drawn into said first chamber from said source and air to be expelled from said second chamber to the intake manifold when moved through its first stroke, said pumping member causing air to be moved from said first chamber to said second chamber via said second check valve means when moved through its second stroke, an actuating means including a reciprocable actuating member movable through first and second strokes and which is connected to said pumping member to move the same through its first and second strokes, one side of said actuating member being in communication with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and a variable rate spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said spring means having a non-linear variable spring rate which exerts a progressively higher biasing force as the pressure of the exhaust gas pulsations increases with increasing engine speed whereby said pump assembly is operable to pump air from said source during engine speeds when portions of the amplitude of the pressure pulsations are at subatmospheric pressure and during engine speeds when the entire amplitude of the pressure pulsations is wholly above atmospheric pressure.

6. In combination, a vacuum pump assembly and an internal combustion engine which generates exhaust gases having pressure pulsations of varying pressure, frequency and amplitude at different engine speeds and which has an intake manifold, said pump assembly comprising:

a staged pump means for pumping air from a source to the intake manifold to create a negative pressure at the source, said pump means including a housing, a reciprocable pumping member movable relative to the housing through first and second strokes and which divides the housing into first and second chambers on opposite sides of the pumping member, said first chamber being in communication with said source via first one-way check valve means and said second chamber being in communication with said intake manifold, said pumping member carrying second one-way check valve means for controlling communication between said first and second chambers, said first chamber having a volume which is approximately twice as great as the second chamber, said pumping member causing air to be drawn into said first chamber from said source and air to be expelled from said second chamber to the intake manifold when moved through its first stroke, said pumping member causing air to be moved from said first chamber to said second chamber via said second check valve means when moved through its second stroke, an actuating means including a reciprocable actuating member movable through first and second strokes and which is connected to said pumping member to move the same through its first and second strokes, one side of said actuating member being in communication with said exhaust gases and said pressure pulsations during their increasing pressure phase of each amplitude causing the actuating member and pumping member to be moved through their first stroke and during their decreasing pressure phase of each amplitude allowing the actuating and pumping members to be moved through their second stroke, and a variable rate spring means operatively engageable with one of said actuating and pumping members for biasingly opposing movement of said actuating and pumping members through their first strokes and for moving said actuating and pumping members through their second strokes during the decreasing pressure phase of each amplitude of the pressure pulsations, said spring means having a non-linear variable spring rate which exerts a progressively higher biasing force as the pressure of the exhaust gas pulsations increases with increasing engine speed whereby said pump assembly is operable to pump air from said source during engine speeds when portions of the amplitude of the pressure pulsations are at subatmopheric pressure and during engine speeds when the entire amplitude of the pressure pulsations is wholly above atmospheric pressure.

* * * * *

UNITED STATES PATENT AND TRADEMARK OFFICE

CERTIFICATE OF CORRECTION

PATENT NO. : 4,502,847

DATED : March 5, 1985

INVENTOR(S) : Donald J. Pozniak; Gerald F. Robertson and Michael J. McClain

It is certified that error appears in the above-identified patent and that said Letters Patent is hereby corrected as shown below:

Column 1, line 40, after "assignee" insert -- of --.

Column 10, line 23, after "114" insert a period.

Column 13, lines 40-41, delete "communiation" and insert -- communication --.

Column 15, line 65, delete "crease" and insert -- create --.

Signed and Sealed this

*Twenty-second* Day of *July 1986*

[SEAL]

*Attest:*

DONALD J. QUIGG

*Attesting Officer*

*Commissioner of Patents and Trademarks*